US007543579B2

(12) United States Patent
Chang

(10) Patent No.: US 7,543,579 B2
(45) Date of Patent: Jun. 9, 2009

(54) APPARATUS FOR LOADING AND UNLOADING PELLETS IN A SLINGSHOT

(76) Inventor: Shiow-Ching Chang, 1F, No. 26, Lane 65, Chi Shan Rd., Hsi Tun Dist., Taichung City (TW)

( * ) Notice: Subject to any disclaimer, the term of this patent is extended or adjusted under 35 U.S.C. 154(b) by 371 days.

(21) Appl. No.: 11/515,523

(22) Filed: Sep. 5, 2006

(65) Prior Publication Data

US 2008/0053421 A1 Mar. 6, 2008

(51) Int. Cl.
*F41B 3/02* (2006.01)

(52) U.S. Cl. ..... 124/20.2; 124/20.1; 124/50

(58) Field of Classification Search ..... 124/20.1, 124/20.2, 20.3, 45, 49, 50, 51.1; 221/194, 221/195, 196, 197, 246, 247, 248, 249, 268, 221/269, 270, 272, 276
See application file for complete search history.

(56) References Cited

U.S. PATENT DOCUMENTS 1,487,973 A * 3/1924 Preston ..... 124/20.2
2,433,472 A * 12/1947 McLaughlin ..... 221/251
2,483,039 A * 9/1949 Davis ..... 124/50
2,683,554 A * 7/1954 Mulhauser, Jr. ..... 221/152
3,057,337 A * 10/1962 Rock et al. ..... 124/20.2
3,270,734 A * 9/1966 Clements ..... 124/20.2
3,407,798 A * 10/1968 Rock ..... 124/20.2
3,471,056 A * 10/1969 Kovac ..... 221/151
4,583,513 A * 4/1986 Ellenburg et al. ..... 124/20.2
6,948,634 B2 * 9/2005 Evans et al. ..... 221/202

* cited by examiner

*Primary Examiner*—John Ricci
(74) *Attorney, Agent, or Firm*—Jackson Walker, LLP

(57) ABSTRACT

An apparatus for loading and unloading pellets in a slingshot includes a handle and a magazine. The handle is hollow. The magazine is mounted in the handle and has a body and a switch. The body has a lower end, a receiving space defined in the body, a sliding hole defined through the lower end and a channel. The channel is defined in the lower end and communicates with the receiving space and the sliding hole. The switch is mounted slidably in the sliding hole and has a baffle, a resilient element, a through hole and a hook. The resilient element is mounted on the baffle. The through hole is defined through the baffle and corresponds to the channel of the body. The hook is mounted on the baffle and extends over the through hole.

13 Claims, 5 Drawing Sheets

APPARATUS FOR LOADING AND UNLOADING PELLETS IN A SLINGSHOT

BACKGROUND OF THE INVENTION

1. Field of Invention

The present invention relates to a loading apparatus, and more particularly to an apparatus for loading and unloading pellets in a slingshot that can load and unload pellets conveniently.

2. Description of the Related Art

A conventional slingshot for projecting pellets comprises a forked handle and two elastic strips attached respectively to the handle. A pocket for holding a pellet is attached to the elastic strips. To project a pellet, the pocket with a pellet is pulled back and the elastic strips are stretched. After releasing the pocket, the pellet is propelled toward a target as the elastic strips contract from the stretched position.

However, the conventional slingshot can not carry a plurality of pellets so the pellets must be carried separately by a user with a pouch. Taking out the pellets from the pouch is inconvenient and slows down the speed of projecting pellets. Furthermore, because the pellets are often small steel balls, excessive pellets may fall out and spread on the ground easily when taking the pellets from the pouch.

To overcome the shortcomings, the present invention provides an apparatus for loading and unloading pellets in a slingshot to mitigate or obviate the aforementioned problems.

SUMMARY OF THE INVENTION

The primary objective of the present invention is to provide an apparatus for loading and unloading pellets in a slingshot that allows the slingshot to carry a plurality of pellets and unload the pellets conveniently.

The apparatus for loading and unloading pellets in a slingshot in accordance with the present invention comprises a handle and a magazine. The handle is hollow and comprises an upper end, a lower end, an inner wall and an opening defined in the lower end of the handle. The magazine is mounted in the handle and comprises a body and a switch. The body has an upper end, a lower end, two sides, a receiving space defined in the body, a sliding hole defined through the lower end of the body and a channel. The channel is defined in the lower end of the body and communicates with the receiving space and the sliding hole. The switch is mounted slidably in the sliding hole and comprises a baffle, a resilient element, a through hole and a hook. The resilient element is mounted on the baffle and abuts the inner wall of the handle. The through hole is defined through the baffle and corresponds to the channel of the body. The hook is mounted on the baffle and extends over the through hole.

Other objectives, advantages and novel features of the invention will become more apparent from the following detailed description when taken in conjunction with the accompanying drawings.

DETAILED DESCRIPTION OF THE INVENTION

Figure 1:
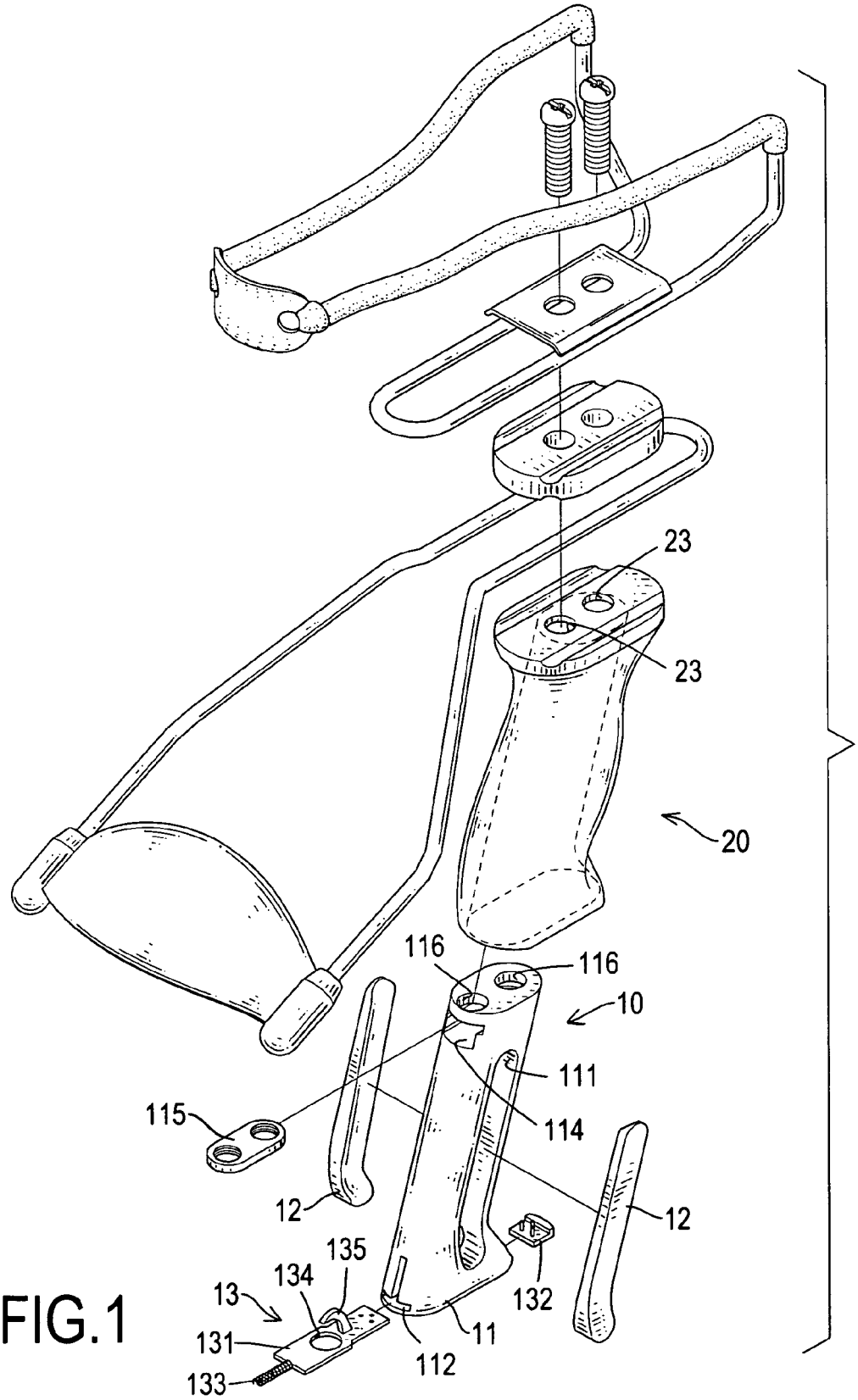
FIG. 1 is an exploded perspective view of a slingshot with an apparatus for loading and unloading pellets in accordance with the present invention.
Figure 2:
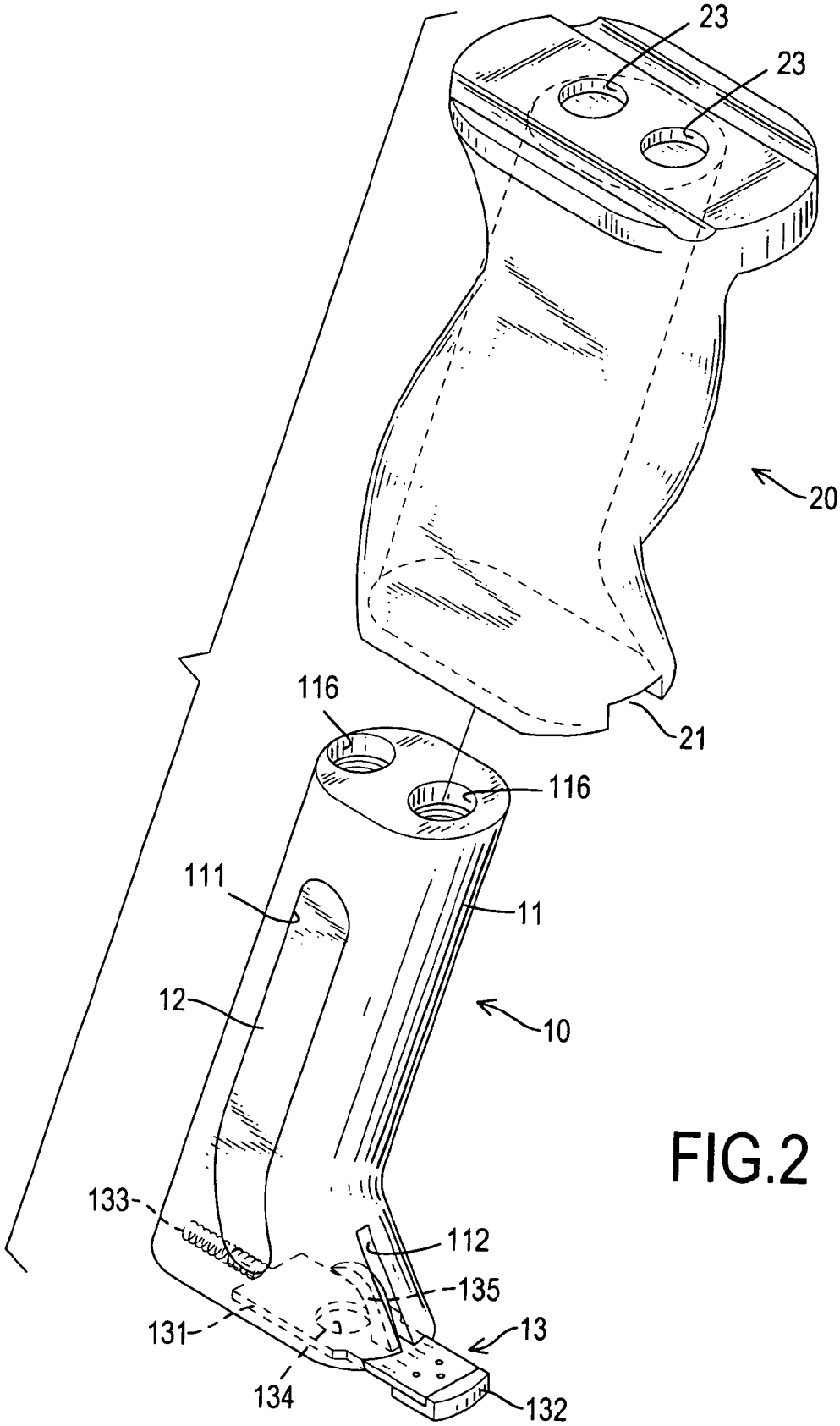
FIG. 2 is a perspective view of the apparatus for loading and unloading pellets in FIG. 1.
Figure 3:
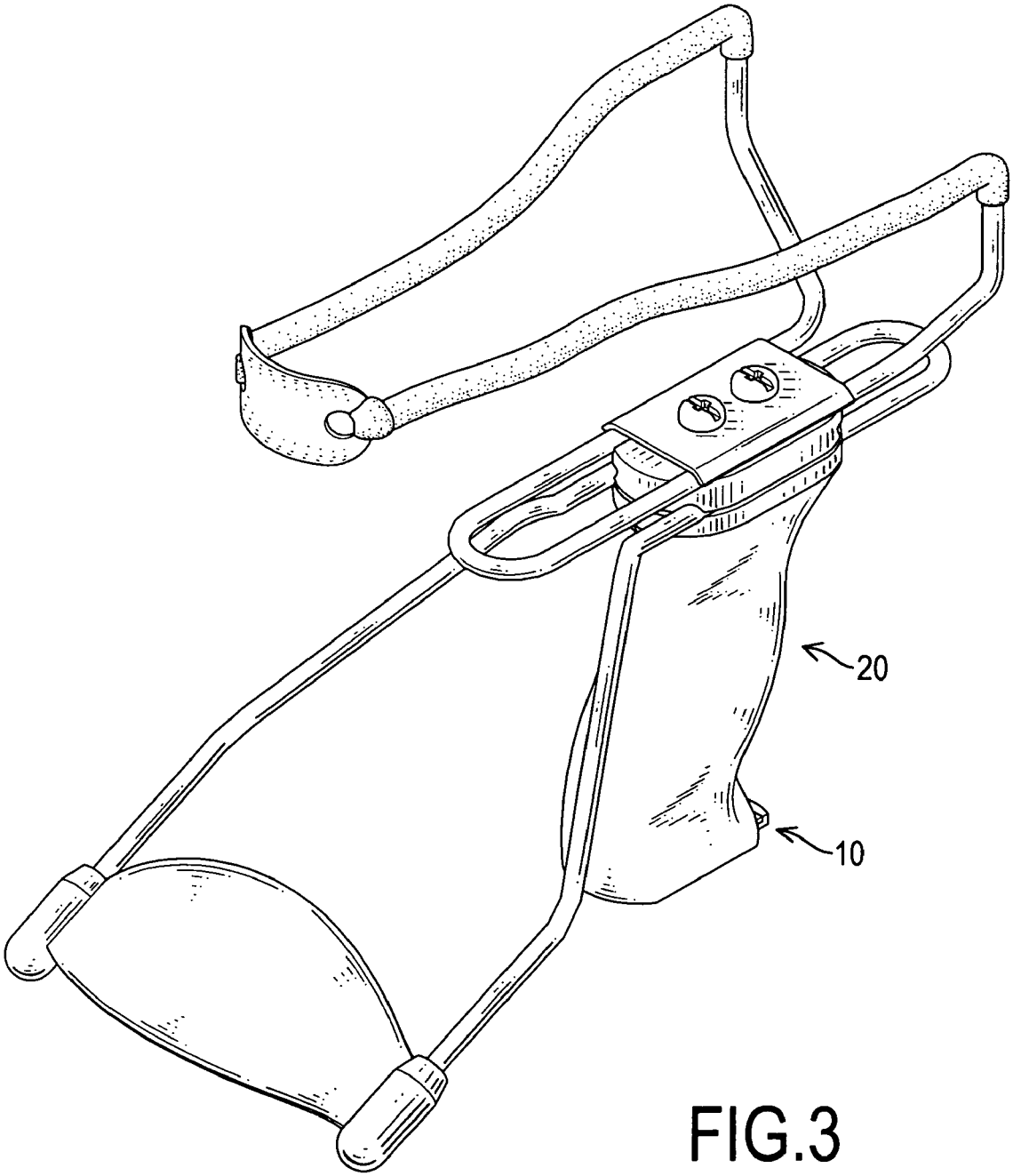
FIG. 3 is a perspective view of the slingshot with the apparatus for loading and unloading pellets in FIG. 1.

With reference to FIGS. 1, 2, 3 and 4, an apparatus for loading and unloading pellets in a slingshot in accordance with the present invention comprises a handle (20) and a magazine (10).

The handle (20) is hollow and has an upper end, a lower end, an inner wall, an opening, a sliding slot (21), a positioning recess (22) and two fastening holes (23). The opening is defined in the lower end of the handle (20). The sliding slot (21) is defined in the lower end of the handle (20). The positioning recess (22) is defined in the inner wall near the lower end of the handle (20). The fastening holes (23) are defined in the upper end of the handle (20) to fasten other components of the slingshot to the handle (20).

The magazine (10) is mounted in the handle (20) and comprises a body (11), two side caps (12) and a switch (13). The body (11) is substantially a column, is extended longitudinally and has an upper end, a lower end, two sides, a receiving space (111), a sliding hole (112), a channel (113), a receiving recess (114), a mounting member (115) and two mounting holes (116). The receiving space (111) for receiving the pellets is defined in the body (11) and forms two openings respectively on the sides of the body (11). The sliding hole (112) is inverted T-shaped, is defined transversely through the lower end of the body (11) and has a longitudinal portion and a transverse portion. The transverse portion has two sides and one side of the transverse portion is narrower than the other side. The channel (113) is defined in the lower end of the body and communicates with the receiving space (111) and the sliding hole (112) to load and unload the pellets through the channel (113). The receiving recess (114) is defined near the upper end of the body (11). The mounting member (115) is mounted in the receiving recess (114) to fasten another components of the slingshot. The mounting holes (116) are defined in the upper end of the body (11) and communicates with the receiving recess (114) and the fastening holes (23) of the handle (20).

The side caps (12) are corresponding to the openings on the sides of the body (11) and are mounted respectively on the sides of the body (11) to close the openings of the receiving space (111). The side caps (12) have an upper end and lower end thicker than the upper end. When the side caps are mounted respectively on the sides of the body (11), the receiving space (111) is closed and has a lower portion and an upper portion. The upper portion has a diameter larger than that of the lower portion and only one pellet can be received in the lower portion. Accordingly, blocking up the channel (113), which is resulted by several pellet being stuck in the lower portion, can be avoided and the pellets can be unloaded one by one easily.

The switch (13) is mounted in the sliding hole (112) of the body (11) slidably and comprises a baffle (131), an optional blocking element (132), a resilient element (133), a through hole (134) and a hook (135). The baffle (131) is mounted slidably in the transverse portion of the sliding hole (112) to close the channel (113) and has two ends. One end of the baffle (131) is narrower than the other end. When the baffle (131) is mounted in the sliding hole (112), the narrower end of the baffle (131) can protrude out of the narrower side of the transverse portion and protrude out of the handle (20) through the sliding slot (21). The blocking element (132) is mounted on the narrower end of the baffle (131) to prevent the baffle (131) from falling out from the sliding hole (112). The resilient element (133) is mounted on the end of the baffle (131), abuts the positioning recess (22) of the handle (20) to reposition the switch (13) and may be a spring or the like. The through hole (134) is defined through the baffle (131) and is corresponding to the channel (113) of the body (11) to allow the pellets to pass through the baffle (131). The hook (135) is mounted on the baffle (131), is received slidably in the longitudinal portion of the sliding hole (112) and is extended over the through hole (134) to keep the pellets from falling down.

Figure 4:
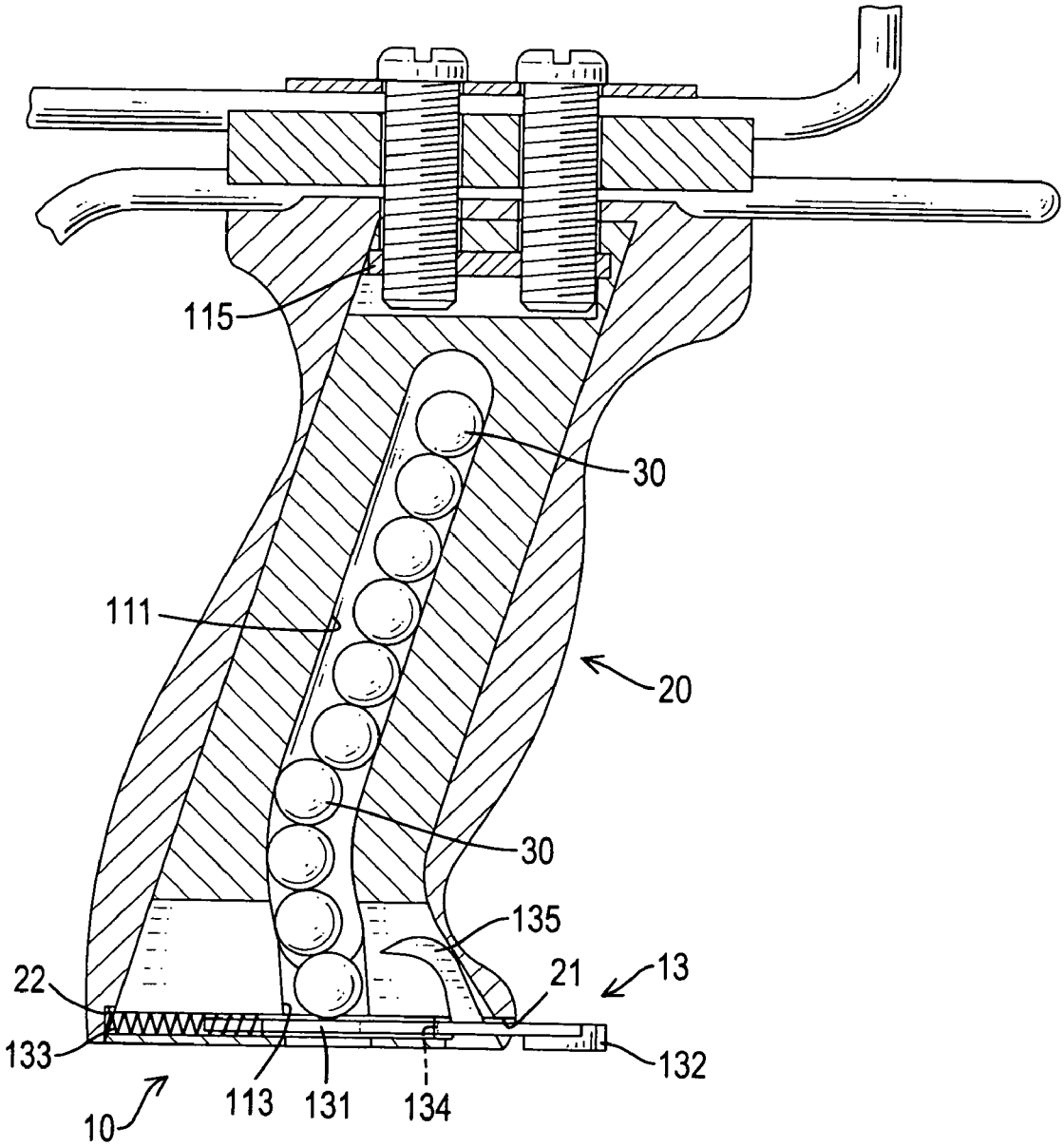
FIG. 4 is a side view in partial section of the apparatus for loading and unloading pellets in FIG. 1.
Figure 5:
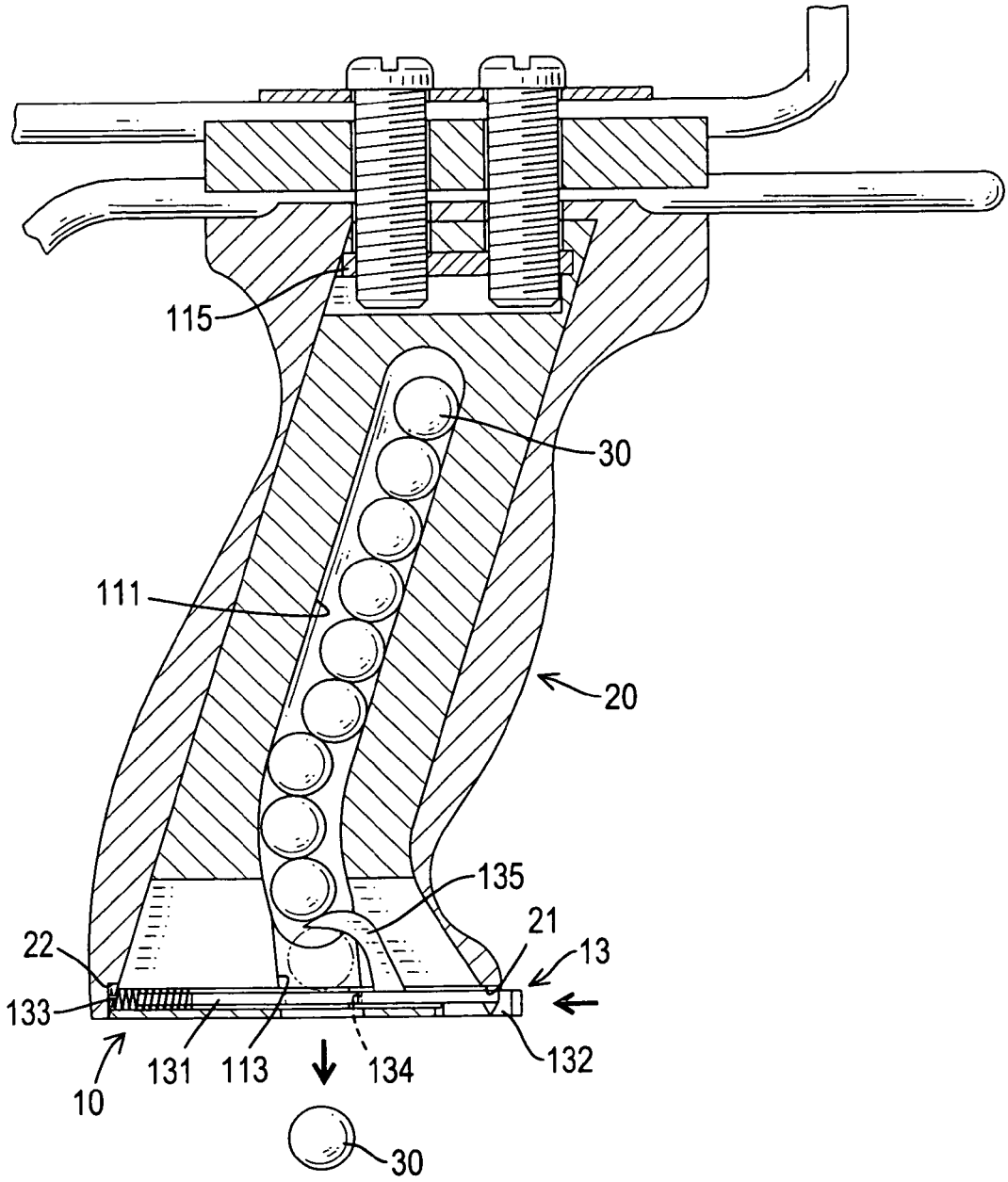
FIG. 5 is an operational side view in partial section of the apparatus for loading and unloading pellets in FIG. 4 with the pellets being unloaded from the magazine.

When the pellets are loaded into the magazine (10), the magazine (10) is inverted and the switch (13) is pressed to communicate the through hole (134) on the baffle (131) with the channel (113) of the body (11). With further reference to FIGS. 4 and 5, when the pellets are unloaded from the magazine (10), the switch (13) is pressed and the bottommost pellet is separated from other pellets by the hook (135) on the switch (13). Only one pellet will fall out from the through hole (134) and be unloaded. Accordingly, the pellets can be unloaded one by one to prevent a plurality of pellets from falling out and spreading on the ground. With the apparatus for loading and unloading pellets in a slingshot, the pellets can be loaded and unloaded easily and quickly and the speed of projecting the pellets can also be increased.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. An apparatus for loading and unloading pellets in a slingshot comprising a handle being hollow and comprising
- an upper end;
- a lower end;
- an inner wall; and
- an opening being defined in the lower end of the handle; a magazine being mounted in the handle and comprising
- a body having
  - an upper end;
  - a lower end;
  - two sides;
  - a receiving space being defined in the body;
  - a sliding hole being defined through the lower end of the body; and
  - a channel being defined in the lower end of the body and communicating with the receiving space and the sliding hole; and
  - two side caps being mounted respectively to the sides of the body to close the receiving space of the body and each side cap having an upper end and a lower end thicker than the upper end; and
- a switch being mounted slidably in the sliding hole and comprising
  - a baffle having two ends;
  - a resilient element being mounted on the baffle and abutting the inner wall of the handle;
  - a through hole being defined through the baffle and corresponding to the channel of the body; and
  - a hook being mounted on the baffle and extended over the through hole.

2. The apparatus for loading and unloading pellets in a slingshot as claimed in claim 1, wherein
- the receiving space has a lower portion with a diameter and an upper portion having a diameter larger than that of the lower portion.

3. The apparatus for loading and unloading pellets in a slingshot as claimed in claim 2, wherein the resilient element is a spring.

4. The apparatus for loading and unloading pellets in a slingshot as claimed in claim 2, wherein the sliding hole is inverted T-shaped.

5. The apparatus for loading and unloading pellets in a slingshot as claimed in claim 4, wherein
- the sliding hole has a longitudinal portion and a transverse portion having two sides and one side of the transverse portion is narrower than the other; and
- one end of the baffle is narrower than the other end and protrudes out of the narrower side of the transverse portion.

6. The apparatus for loading and unloading pellets in a slingshot as claimed in claim 5, wherein the handle further comprises a sliding slot defined in the lower end of the handle and corresponding to the baffle.

7. The apparatus for loading and unloading pellets in a slingshot as claimed in claim 6, wherein the switch further comprises a blocking element mounted on the narrower end of the baffle.

8. The apparatus for loading and unloading pellets in a slingshot as claimed in claim 7, wherein the handle further comprises a positioning recess defined in the inner wall of the handle and engaged with the resilient element.

9. The apparatus for loading and unloading pellets in a slingshot as claimed in claim 8, wherein
- the body further has a receiving recess defined near the upper end of the body, a mounting element mounted in the receiving recess and two mounting holes defined in the upper end of the body and communicating with the receiving recess; and
- the handle further has two fastening holes defined in the upper end of the handle and communicating respectively with the mounting holes of the body.

10. The apparatus for loading and unloading pellets in a slingshot as claimed in claim 1, wherein the resilient element is a spring.

11. The apparatus for loading and unloading pellets in a slingshot as claimed in claim 1, wherein the sliding hole is inverted T-shaped.

12. The apparatus for loading and unloading pellets in a slingshot as claimed in claim 11, wherein
- the sliding hole has a longitudinal portion and a transverse portion having two sides and one side of the transverse portion is narrower than the other; and
- one end of the baffle is narrower than the other end and protrudes out of the narrower side of the transverse portion.

13. The apparatus for loading and unloading pellets in a slingshot as claimed in claim 12, wherein
- the switch further comprises a blocking element mounted on the narrower end of the baffle.

* * * * *